US006070885A

United States Patent [19]

Ferone

[11] Patent Number: 6,070,885

[45] Date of Patent: Jun. 6, 2000

[54] OFF-LINE ROLLER SKATES

[76] Inventor: Ralph J. Ferone, 12051 Barlett Way NE., Seattle, Wash. 98115

[21] Appl. No.: 08/973,445

[22] PCT Filed: Jun. 17, 1996

[86] PCT No.: PCT/US96/10533

§ 371 Date: Jun. 1, 1998

§ 102(e) Date: Jun. 1, 1998

[87] PCT Pub. No.: WO97/00104

PCT Pub. Date: Jan. 3, 1997

Related U.S. Application Data

[60] Provisional application No. 60/000,306, Jun. 19, 1995.

[51] Int. Cl.[7] ..... A63C 17/00; A63C 17/14

[52] U.S. Cl. ..... 280/11.19; 280/11.2

[58] Field of Search ..... 280/11.19, 11.2, 280/11.22, 11.27, 11.28

[56] References Cited

U.S. PATENT DOCUMENTS

| | | | |
|---|---|---|---|
| 97,075 | 11/1869 | Gibson . | |
| 208,235 | 9/1878 | Gregg | 280/11.19 |
| 233,845 | 11/1880 | Gregg | 280/11.19 |
| 296,833 | 4/1884 | Hanlon . | |
| 926,646 | 6/1909 | Eubank . | |
| 954,993 | 4/1910 | Peters . | |
| 1,017,162 | 2/1912 | Naumann . | |
| 1,334,609 | 3/1920 | Guindon . | |
| 1,379,250 | 2/1921 | Clark | 280/11.19 |
| 1,445,048 | 2/1923 | Spross . | |
| 1,687,739 | 10/1928 | Slusher . | |
| 2,166,767 | 7/1939 | Peterman . | |
| 2,245,769 | 6/1941 | Flamm . | |
| 3,871,672 | 3/1975 | Bardy . | |
| 4,166,519 | 9/1979 | Maloney . | |
| 4,194,751 | 3/1980 | Shinmura . | |
| 4,275,895 | 6/1981 | Edwards . | |
| 4,603,868 | 8/1986 | Schutz . | |
| 4,763,909 | 8/1988 | Bergeron . | |
| 5,165,708 | 11/1992 | I-Chuan | 280/11.19 |
| 5,183,276 | 2/1993 | Pratt . | |
| 5,224,718 | 7/1993 | Gertler . | |
| 5,251,920 | 10/1993 | McHale | 280/11.19 |
| 5,549,309 | 8/1996 | Gleichmann | 280/11.19 |

*Primary Examiner*—Lanna Mai
*Assistant Examiner*—Jeff Restifo
*Attorney, Agent, or Firm*—John J. Connors; Connors & Assoc.

[57] ABSTRACT

A roller skate 100 includes a support 2*a* attached to a skater's foot. First and second non-aligned axles 9 and 10 are attached to the forward end of a support 2*a* and extend sideways from the inside of the support, with the second axle 10 being closer to the center c of the skater's foot than the first axle 9. Third and fourth non-aligned axles 18 and 19 are attached to the rear end of the support 2*a* and extend sideways from the outside of the support, with the third axle 19 being closer to the center c of the skater's foot than the fourth axle 18. Wheels 12 and 16 and wheels 13 and 15 are mounted for rotation on the axles.

31 Claims, 7 Drawing Sheets

OFF-LINE ROLLER SKATES

RELATED PATENT APPLICATION

This application is a utility application based on, and entitled to the benefit of the filing date of, U.S. provisional application Ser. No. 60/000,306, entitled "EZ Glides/Off-Line Skate System With Dual Axles," filed Jun. 19, 1995. This provisional application is incorporated herein by reference and made a part of this application.

BACKGROUND OF THE INVENTION

1. Field of the Invention

This invention relates to roller skates, and in particular to off-line roller skates.

2. Background Discussion

Roller skates are well known and come in a wide variety of configurations. Two broad categories of skates are in-line and off-line skates. An in-line skate is one in which the wheels are positioned below the foot of the skater directly under and along the longitudinal axis of the skate's base plate, or skater's foot. Currently, in-line skates are very popular. An off-line skate is one in which the wheels of the skate are laterally displaced from the longitudinal axis of the base plate. For beginners, it can be difficult to maintain one's balance when skating on in-line skates. The reason for this is because all the wheels are directly under the longitudinal axis of the base plate, and the contact with the ground provided by the in-line skate wheels is narrow. Therefore, when a skater leans to one side, the lateral pressure exerted on the in-line skates can result in an unstable condition where the wheels may slide sideways in a skid, producing a fall. Moreover, certain natural objects such as twigs, small rocks, or cracks in streets and sidewalks, can inhibit the rotation of the small wheels of the in-line skate. Particularly troublesome for in-line skaters is where street or side walk cracks line up with the in-line skate wheels, jamming the wheels and throwing the skater off balance. Also, the jarring effects in-line skates and conventional off-line roller skates are subjected to on rough or irregular streets or sidewalks limit their use. Overall in-line skates and conventional off-line roller skates are maneuverable and fast. With off-line skates, however, it is easier to maintain one's balance, and off-line skates are more stable than in-line skates.

SUMMARY OF THE INVENTION

This invention provides an off-line skate which has the desirable characteristics of speed, stability, balance, maneuverability, smoothness of ride, and energy conservation because of the skate's unique wheel configuration enhances momentum. The skate of this invention can easily roll over objects such as small holes, twigs, pebbles, rough surfaces, and cracks in streets and sidewalks which can inhibit the performance of conventional skates. The skate is safe and easy to learn and skate on for both children and adults who have found in-line skating to be difficult or intimidating. It is comfortable and suitable for travel both for short and long distances on city and suburan streets and sidewalks. Lastly, the skate of this invention is fun and exciting to skate on and gives new meaning to recreational skating.

The roller skate of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include speed, stability, balance, maneuverability and ease of use, smoothness of ride, and effort minimizing skating.

The first feature of the roller skate of this invention is that it includes a support which is attached to a skater's foot, for example as a foot plate integral with, or secured to, a boot or shoe worn by a skater, or a frame which may be easily attached or detached to the boot or shoe and adjusted to accommodate different foot sizes. The support has a central longitudinal axis, first and second opposed sides, a forward end, and a rear end.

The second feature is a first pair of non-aligned axles attached to the forward end of the support and which extend sideways from the first side of the support, and a second pair of non-aligned axles attached to the rear end of the support and which extend sideways from the second side of the support. These axles are generally parallel to each other and at substantially right angles to the longitudinal axis of the support. Two axles may be in the same plane but still are non-aligned so long as they are not on a common axis.

The third feature is a first pair of wheels mounted for rotation, one wheel of the first pair is mounted to one of the axles of the first pair of axles and the other wheel of the first pair is mounted to the other axle of the first pair of axles. The first pair of wheels are positioned so that, upon attaching the support to the skater's foot with the longitudinal axis of the support aligned with the longitudinal axis of the skater's foot and the rear end near the heel of the skater's foot and the forward end near the toes of the skater's foot, one wheel of the first pair is to one side of the skater's foot and the other wheel of the first pair is below the skater's foot. Both of the wheels of the first pair are displaced from the longitudinal axis of the support towards the first side of the support.

The fourth feature is a second pair of wheels mounted for rotation, one wheel of the second pair is mounted to one of the axles of the second pair of axles and the other wheel of the second pair is mounted to the other axle of the second pair of axles. The second pair of wheels are positioned so that, upon attaching the support to the skater's foot with the longitudinal axis of the support aligned with the longitudinal axis of the skater's foot and the rear end near the heel of the skater's foot and the forward end near the toes of the skater's foot, one wheel of the second pair is to the other side of the skater's foot and the other wheel of the second pair is below the skater's foot. Both of the wheels of the second pair are displaced from the longitudinal axis of the support towards the second side of the support.

The fifth feature is that the axles and wheels are sized, configured and positioned in a unique fashion to provide the desired benefits of speed, stability, balance, smoothness of ride, maneuverability, and effort minimizing skating. Preferably, the wheels mounted to the sides of the skater's foot have a larger diameter than the wheels mounted below the skater's foot; however, the wheels mounted to the sides of the skater's foot may have the same diameter as the wheels mounted below the skater's foot. The diameters of the wheels are from 1 inch to 10 inches, with the diameters of the wheels mounted to the side of the skater's foot being from 2 inch to 10 inches and the diameters of the wheels mounted to below the skater's foot being from 1 inch to 5 inches. In one embodiment of this invention, the larger diameter wheels are approximately twice the diameter of the wheels mounted below the skater's foot. The axles carrying the wheels mounted to the sides of the skater's foot are positioned inward closer to the center of the skater's foot than the other axles. The axle at the forward end of the support carrying the wheel mounted below the skater's foot is essentially under the toes of the skater's foot. The first pair of wheels are on the inside of the skater's foot and the second pair of wheels are on the outside of the skater's foot, and the wheel at the forward end of the support mounted below the skater's foot may be adjustable to move to selected forward and rearward positions. The wheels mounted below the skater's foot may be adjustable to move to selected lateral positions. With respect to the first pair of axles, the axle carrying the wheel to one side of the skater's foot is positioned between the tip of the big toe and the ball of the skater's foot. Although it is preferred to use four wheels, it is possible to use only three wheels. For example, either the front or rear wheels below the skater's foot may be eliminated.

DESCRIPTION OF THE DRAWING

The preferred embodiments of this invention, illustrating all its features, will now be discussed in detail. These embodiments depict the novel and non-obvious off-line roller skates of this invention as shown in the accompanying drawing, which is for illustrative purposes only. This drawing includes the following figures (FIGS.), with like numerals indicating like parts.

DETAILED DESCRIPTION OF THE PREFERRED EMBODIMENTS

Figure 1:
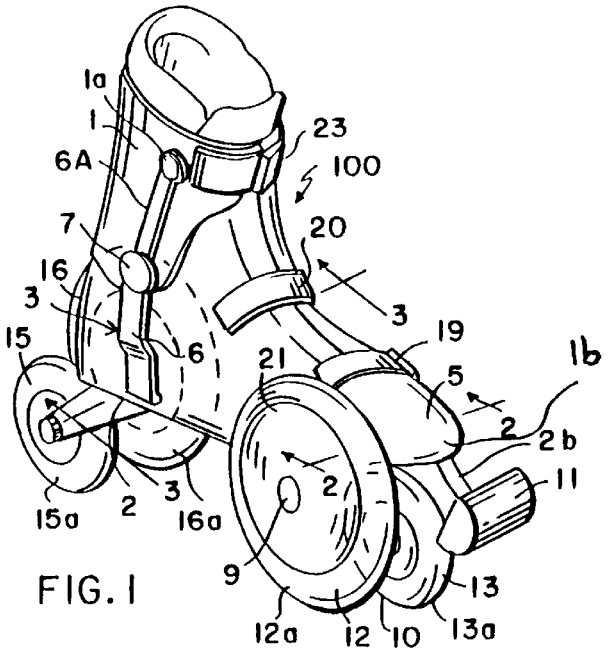
FIG. 1 is a perspective view of the left foot of the first embodiment of the invention, showing a boot with an attached skate base plate, including a view of an ankle brace that is attached to the base plate.

First Embodiment:

Referring to FIGS. 1 through 6, the first embodiment of the off-line skate of this invention, the skate 100, includes a boot 1 attached to a metal frame 2 whose base plate 2*a* is shaped to the approximate shape of the boot's bottom. The boot 1 is held in place by two conventional clasps 19 and 20 and it comes in various sizes. The front of the base plate 2*a* has a rounded portion that goes within the toe 5 of the boot 1, while the heel 4 of the boot 1 wraps around and over the sides 2*c* (FIG. 3) of the base plate 2*a*. Attached to the base plate 2*a* is an ankle brace 3 consisting of arms 6 and 6A that run up the side to the boot 1 and are connected together by a rotating joint 7 positioned near a point opposite an average skater's ankle. The rotating joint 7, moving the arm 6A, allows the upper portion of the boot 1 to rotate forward and backward with the skater's ankle movement. From the rotating joint 7 the arm 6A continues upward over the ankle to couple into the upper part 1*a* of the boot 1. The ankle brace 3 includes a conventional clasp 23 which holds the brace in place.

Figure 4:
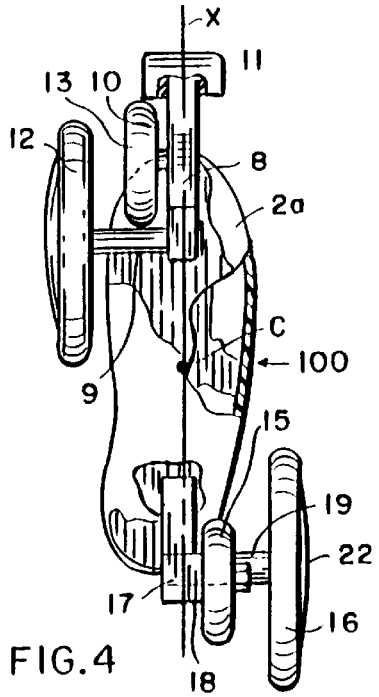
FIG. 4 is a plan view of the boot plate of the first embodiment that shows relative longitudinal and lateral placement of the left foot skate wheels.
Figure 2:
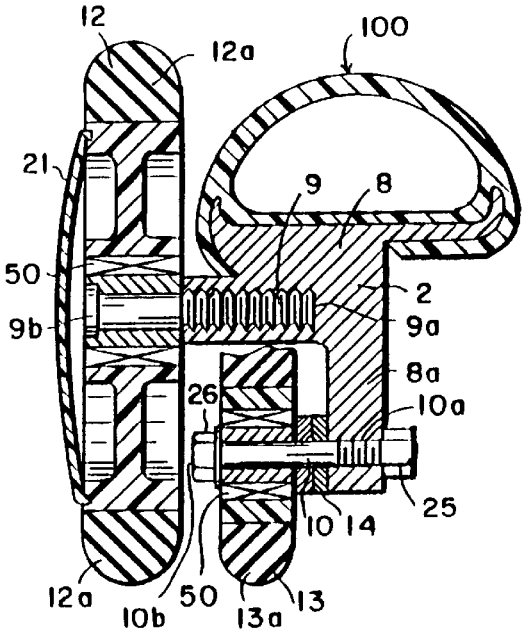
FIG. 2 is a cross-sectional view of the front axles of the first embodiment taken along line 2—2 of FIG. 1, showing (a) how both axles are supported by the boot and the lateral displacement of the smaller inboard wheel, and (b) spacers adjacent a wheel holding bracket arm. These spacers can be added or subtracted to change the inboard wheel's lateral placement.
Figure 20:
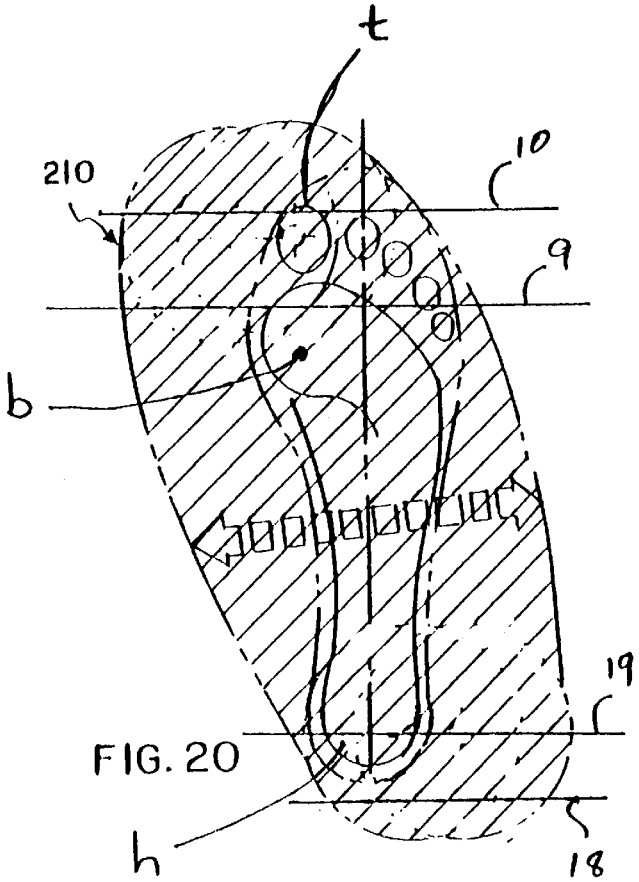
FIG. 20 is a diagram showing the effective foot print of the off-line skate of this invention.

As depicted in FIG. 4, the base plate 2*a* includes a front mounting device or bracket 8 and a rear mounting device or bracket 17. As best shown in FIG. 2, the front mounting bracket 8 is an integral part of the base plate 2*a* and it has a forward end piece 2*b* to which is attached a conventional brake mechanism 11. At the front of the base plate 2*a*, one set or pair of axles 9 and 10 extend outward from the inside of the skater's foot, or boot 1, generally parallel to each other substantially at a right angle to the longitudinal axis x of the base plate 2*a*. At the rear of the base plate 2*a*, another set or pair of axles 18 and 19 extend outward from the outside of the skater's foot, or boot 1, generally parallel to each other substantially at a right angle to the longitudinal axis x of the base plate 2*a*. The axle 9 is closer to the center c of the base plate 2*a*, or skater's foot, than the axle 10, and the axle 19 is closer to the center c of the base plate 2*a*, or skater's foot, than the axle 18. As best shown in FIG. 20, the axle 9 (shown as a line) carrying the wheel 12 is positioned between the tip of the big toe and the ball b of the skater's foot, and the axle 10 (shown as a line) is the most forward axle and it may be slightly forward or slightly behind (about ½ inch) of the tip t of the big toe of the skater's foot, or directly below the big toe of the skater's foot. In all these cases, the axle 10 is considered essentially under the big toe of the skater's foot. The axles 18 (shown as a line) and 19 (shown as a line) are near the heel h of the skater's foot. Preferably, the axle 19 is directly under the end of the heel of the skater's foot, or slightly beyond or slightly forward from this end, and the axle 18 is a little way beyond the heel of the skater's foot. It is possible that the boot 1 may not change sizes with different skaters, and a liner may be inserted into the boot to accommodate the skater's foot size. In that instance, the tip 1*b* of the boot 1, will serve as the point of reference for positioning of the axles 9 and 10 rather than the tip t of the skater's toe.

Figure 3:
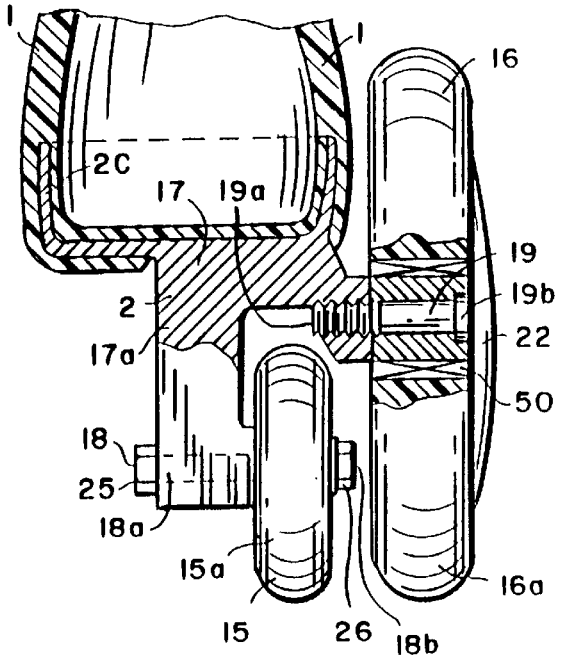
FIG. 3 is a back, a partial cross-sectional view taken along line 3—3 of FIG. 1, showing the lateral displacement of the smaller inboard wheel and how both axles are supported by the boot plate and boot.
Figure 3A:
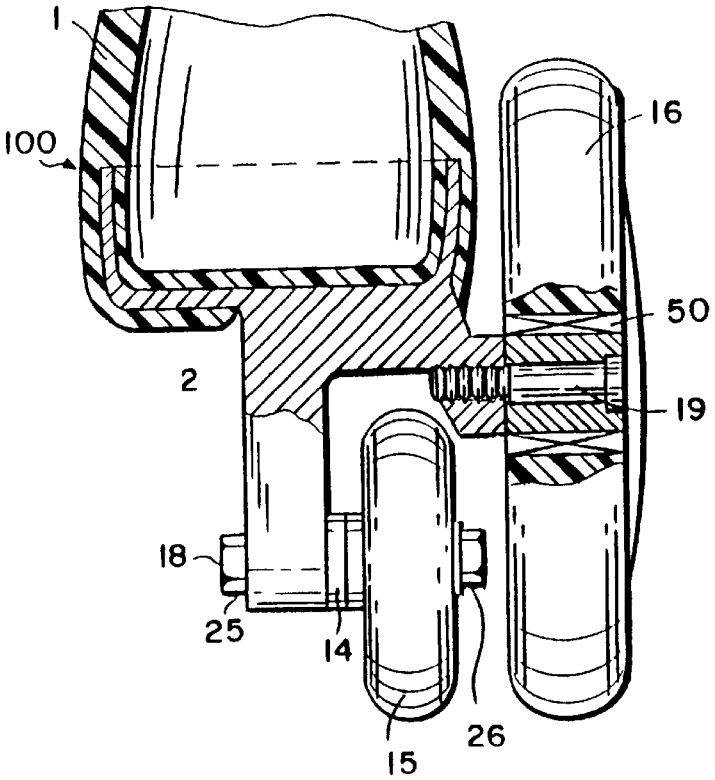
FIG. 3A is a back view, similar to that shown in FIG. 3, showing spacers adjacent a wheel holding bracket arm.
Figure 3B:
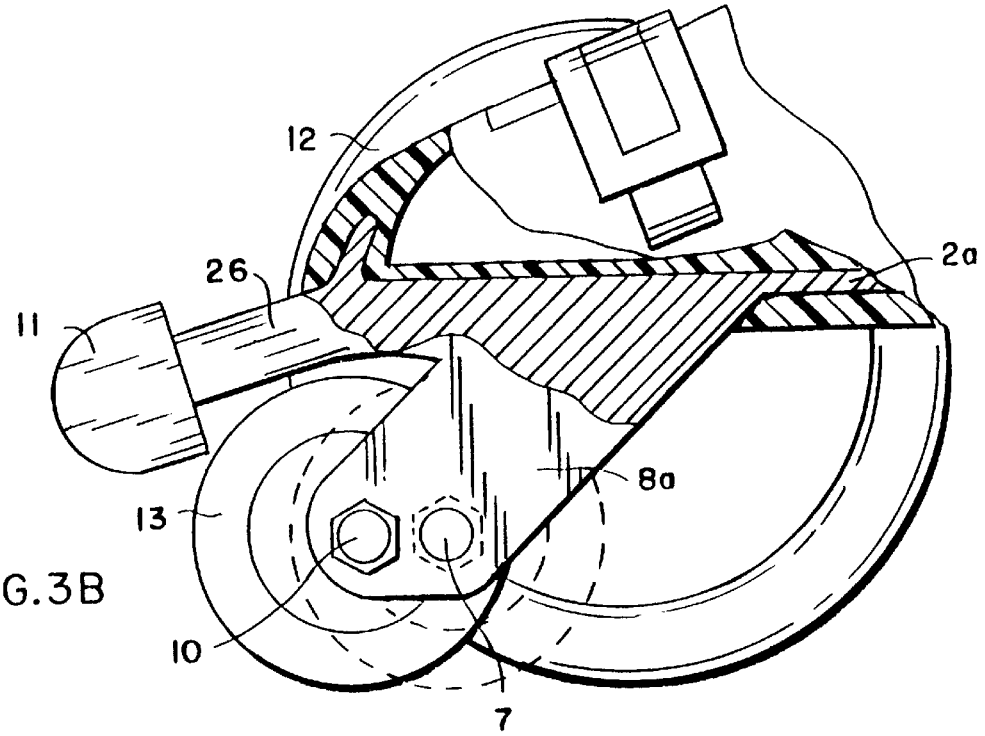
FIG. 3B is a side view, with sections broken away, showing alternate positions for the inboard wheel on the wheel holding bracket arm.
Figure 5:
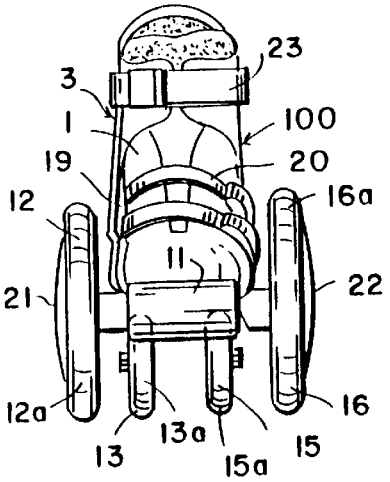
FIG. 5 is a full front view of the first embodiment that shows the brake mechanism on the toe of the boot, and the offset placement of both the large outboard wheels and the smaller inboard pivot balance wheels.
Figure 6:
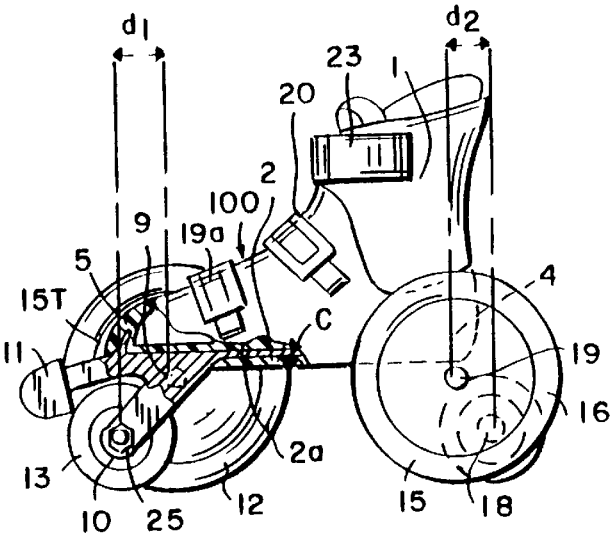
FIG. 6 is a side view, with sections broken away, of the first embodiment, showing the front brake, and longitudinal displacement of the small inboard wheels.

As depicted in FIG. 6, the distance $d_1$ between the axles 9 and 10 typically ranges between 1 and 2.5 inches, and the distance $d_2$ between the axles 18 and 19 typically ranges between ⅛ and 1 inch. These distances may be fixed, or, preferably as shown in FIG. 3B, the distance between the front axles 9 and 10 may be varied by moving the one axle 10 between alternate positions. In the embodiment shown in FIG. 3B, a front mounting bracket arm 8*a* has at least two threaded holes into which the end of the axle 10 is seated. More holes, however, may be provided to increase the number of different positions for the front axle 10. As shown in solid lines, the axle 10 is in the normal or standard position. Moving this axle 10 rearward closer to the axle 9 to seat it in hole 7 allows for increased ability to do trick and free style skating. Because of tire wear, it may also be desirable to provide an adjustment to move the axles 9, 10, 13, and 14 further away from the base plate 2*a*.

A pair of front wheels 12 and 13 are mounted by ball bearing races 50 to the axles 9 and 10, respectively, and a pair of rear wheels 15 and 16 are mounted by ball bearing races 50 to the axles 18 and 19, respectively. The wheels 12, 13, 15, and 16 are of conventional design, and have rubber or plastic tires 12*a*, 13*a*, 15*a*, 16*a*, respectively. The tires 12*a* and 16*a* may be either solid or be filled with air under pressure, and the tires 13*a* and 15*a* are preferably solid. As illustrated in FIGS. 2 and 3, with the wheels 12, 13, 15, and 16 on the ground, the axles 10 and 18 for the inboard wheels 13 and 15 are below the axles 9 and 19 for the outboard wheels 12 and 16. The outboard wheels 12 and 16 have diameters about twice that of the inboard wheels 13 and 15. The front outboard wheel 12 is positioned on the inside of the skater's foot, or the boot 1, and the rear outboard wheel 16 is positioned on the outside of the skater's foot, or the boot 1. The front outboard wheel 12 is mounted on the outer end of the axle 9, facing the opposite skate when in use, and the front inboard wheel 13 is mounted on the outer end of the axle 10 below the skater's foot, or under the base plate 2*a*. Similarly, the rear outboard wheel 16 is mounted on the outer end of the axle 19, and the rear inboard wheel 15 is mounted on the outer end of the axle 18 below the skater's foot, or under the base plate 2*a*. The outboard wheels 12 and 16 are designed to hold decorative discs 21 and 22.

The attachment of the wheels 12, 13, 15, and 16 to their respective axles is conventional, allowing these wheels to be quickly interchanged with various sized substitute wheels. At the ends 9*a* and 19*a*, the axles 9 and 19 are threaded and screwed into threaded receptacles, respectively, in the front mounting bracket 8 and rear mounting bracket 17. The opposite ends 9*b* and 19*b* are enlarged to hold the outboard wheels 12 and 16 in position. The axles 10 and 18 have, respectively, threaded ends 10*a* and 18*a* which pass, respectively, through openings in downwardly extending arms 8*a* and 17*a*, respectively, of the brackets 8 and 17. At one end, nuts 25 are screwed onto the axles 10 and 18, and at opposite ends 10*b* and 18*b*, end caps 26 are force fitted over these ends to hold the inboard wheels 13 and 15 in position. As shown in FIGS. 2 and 3A, spacers 14 may be used with the inboard wheels 13 and 15 to allow the lateral positioning to be changed. Adding or subtracting the number of spacers 14 regulates the lateral displacement of these wheels 13 and 15. Preferably for improved balance, the number of same sized spacers should be used with both wheels 13 and 15 so that these wheels are of equal distances from the longitudinal axis x. The inboard wheels 13 and 15 may be moved towards their adjacent outboard wheels 12 and 16, respectively, so that the distance between these pairs of wheels is about ⅛ inch and the inboard wheels 13 and 15 may be moved to about ⅛ inch away from the longitudinal axis x. The closer the inboard wheels 13 and 15 are to the longitudinal axis x, the greater the stability of the skate. The further away the inboard wheels 13 and 15 are from the longitudinal axis x, the greater the maneuverability of the skate 100.

Figure 7:
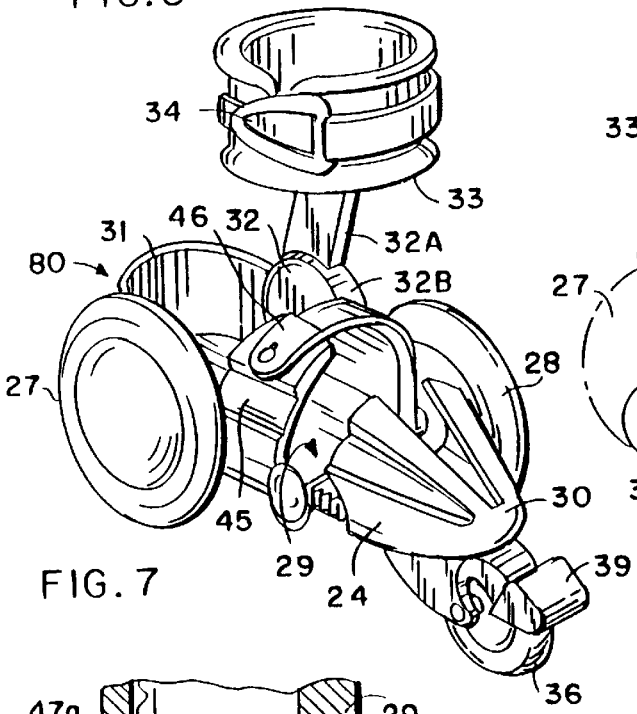
FIG. 7 is a perspective view of the right foot of a second embodiment of this invention, a skate that attaches to a shoe or boot, including an ankle brace that is attached to a base plate.
Figure 8:
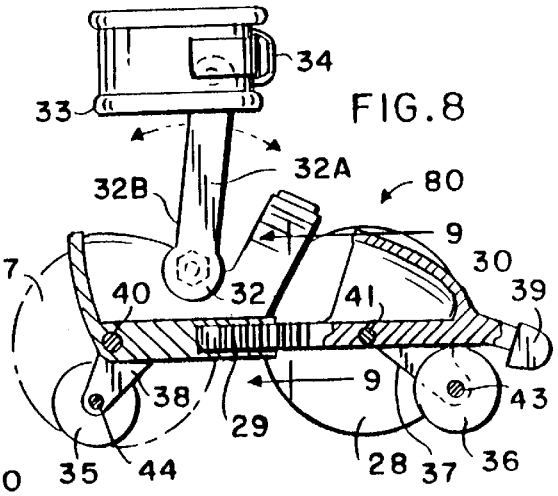
FIG. 8 is a side view, with sections broken away, of the second embodiment of the invention, showing longitudinal positioning of the small inboard wheels, and the front placement of the brake.

Second Embodiment:

As shown in FIGS. 7 and 8, a right foot skate 80 of an alternate embodiment of this invention which is adapted to be attached to the shoe worn by the skater. A shoe or boot is held to the skate by a front toe holding portion 30 of the skate 80, a rear rounded heel holder 31, and a flexible strap 45 which goes over the top of the shoe or boot and is held by a conventional clasping device 46.

This embodiment has a metal frame 24 which is shaped to approximate the outline of the shoe. Attached to the frame 24 in the same arrangement as the first embodiment, are the diagonally opposite large front outboard wheel 28 and large rear outboard wheel 27, with the large front outboard wheel being on the inside of the skate, facing the other opposite skate when in use, and the large rear outboard wheel 27 being on the outside edge of the skate, or outside of the skater's foot. The skate frame 24 consist of a base plate 29, including the toe holding front portion 30 and the heel holding rear portion 31. From the inside foot portion of the skate 80, an ankle brace 32B consisting of a rotating joint 32 from which rises a bar 32A to connect just above the ankle to a leg strap 33, which is held in place by a conventional clasping device 34. The front part of the base plate 29 also extends to include a conventional braking mechanism 39 (FIG. 8).

The large front outboard wheel 28 freely rotates on its axle 41 and is rotatably mounted to the skate frame 24 through conventional means as discussed above. This arrangement allows the quick interchange of various sized front outboard wheels. The small inboard wheel 36 freely rotates around its axle 43 and is rotatably mounted in a conventional manner to a mounting extension 37 which is part of the skate frame 24. The large rear outboard wheel 27 freely rotates around its axle 40 and is rotatably mounted to the base plate 29 of the skate frame 24. This arrangement allows the quick interchange of various sized large rear outboard wheels. The small inboard wheel 35 freely rotates around its axle 44 and is rotatably mounted to the skates rear wheel mounting extension 38.

Figure 9:
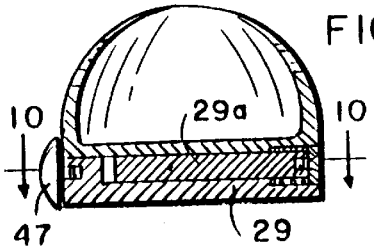
FIG. 9 is a horizontal cross-sectional view taken along line 9—9 of FIG. 8, showing of the locking bolt mechanism for changing the length of the second embodiment.
Figure 11:
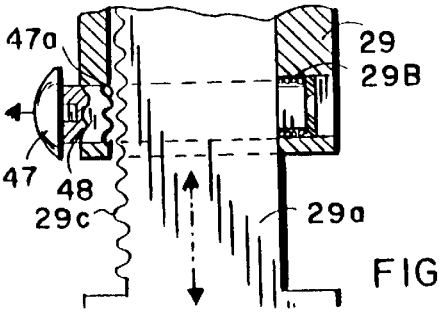
FIG. 11 is a cross-sectional view of the mechanism for changing the length of the second embodiment in the open, or movable position.
Figure 10:
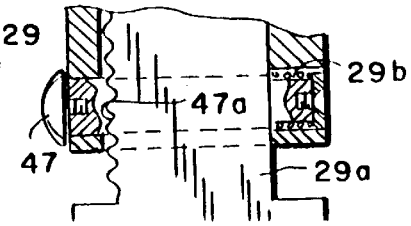
FIG. 10 is a cross-sectional view taken along line 10—10 of FIG. 9, showing the mechanism for changing the length of the second embodiment in the closed, locked position.

The base plate 29 of the second embodiment can be adjusted to varying lengths. As shown in FIGS. 9 through 11, the base plate 29 includes a tongue 29*a* that slides to and fro to accommodate shoes and boots of different sizes. Along one edge of the tongue 29*a* are a series of teeth 29*c*. As shown in FIG. 11, the base plate 29 has a locking mechanism 48 including a spring biased bolt 47 with teeth 47*a* at the head of the bolt. When the bolt 47 is manually moved to the left as shown in FIG. 11, a spring 29*b* coiled around the bolt is compressed and the teeth 47*a* of the bolt 47 disengage from the teeth 29*c* of the tongue 29*a*. This opens the locking mechanism 48, allowing the tongue 29*a* to move to and fro to be adjusted for the sized shoe to which the skate will be attached. When the bolt 47 is released, the spring 29*b* moves the bolt to the right as shown in FIG. 10 so that the teeth 47*a* engage and lock with the teeth 29*c* of the tongue.

Figure 14:
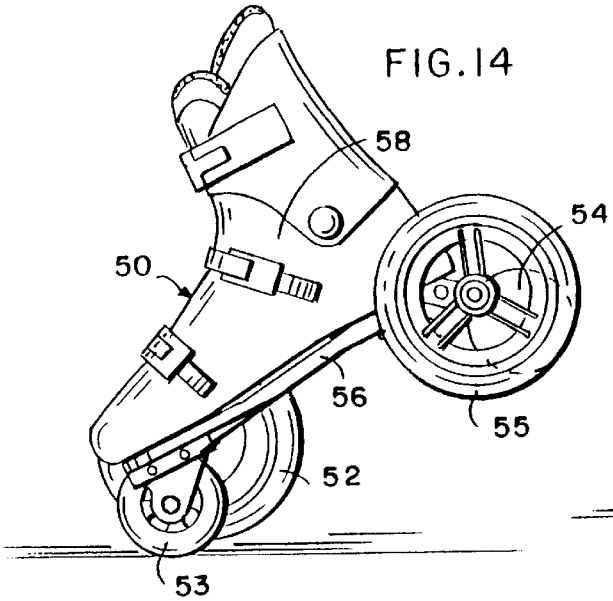
FIG. 14 is a side view of a third embodiment of this invention, a left foot skate which does not use an angle brace, showing how the front inboard wheel is used to pivot the skate.
Figure 15:
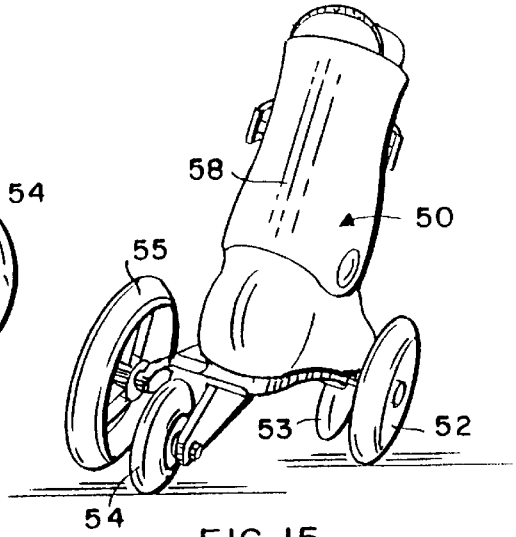
FIG. 15 is a perspective view of the third embodiment of this invention showing wheel shifting where the rear inboard wheel and front outboard wheel remain on the ground while the rear outboard wheel and front inboard wheel lift off the ground when the skater leans to the right preparing to stroke as shown in this FIG. 15.
Figure 16:
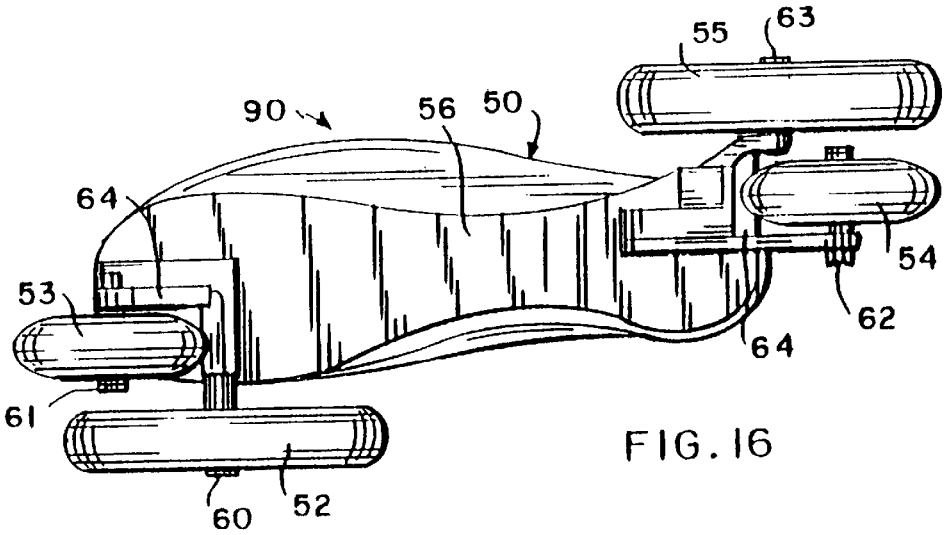
FIG. 16 is a plan view of the third embodiment of this invention showing the base plate of the left foot skate.

Third Embodiment:

As illustrated in FIGS. 14 through 16, a third embodiment of this invention is a skate 50 which does not employ an ankle brace or brake mechanism, but does mount its wheels 52 through 55 in accordance with the arrangement called for by this invention. In this embodiment, a foot plate 56 provides a support on which the wheels 52–55 are mounted essentially in the same manner as discussed above for easy removal and replacement. A boot 58 is secured to this foot plate 56 and the wheels 52–55 are mounted to freely rotate about their respective axles 60 through 63 (FIG. 16) that are attached to brackets 64 on the foot plate 56.

Figure 17:
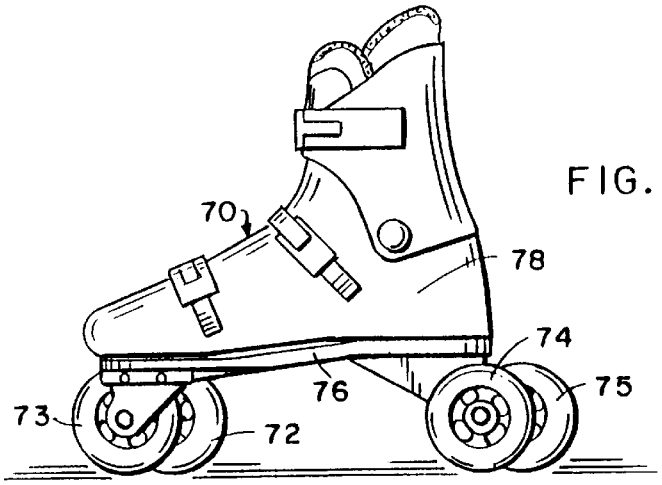
FIG. 17 is a side view of a fourth embodiment of this invention showing the outside of a left foot skate.
Figure 18:
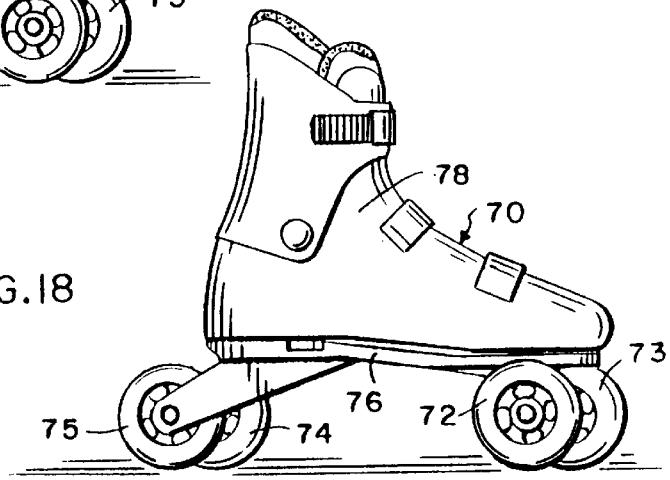
FIG. 18 is a side view of the fourth embodiment of this invention showing the inside of the left foot skate.

Fourth Embodiment:

As illustrated in FIGS. 17 and 18, a fourth embodiment of this invention is a skate 70 which is essentially the same as the third embodiment, except that all the wheels have the same diameter. In this fourth embodiment, a foot plate 76 provides a support on which the wheels 72–75 are mounted essentially in the same manner as discussed above for easy removal and replacement. A boot 78 is secured to this foot plate 76 and the wheels 72–75 are mounted to freely rotate about their respective axles. All the wheels have a diameter of about 3 inches.

Figure 19:
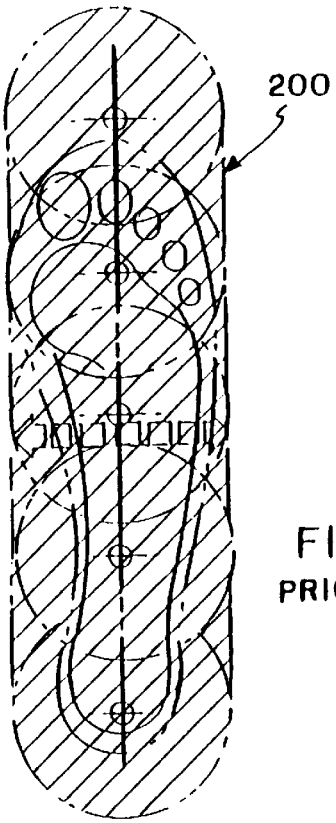
FIG. 19 PRIOR ART
FIG. 19 is a diagram showing the effective foot print of a conventional in-line skate.

Operation of the Skate of This Invention:

Comparing FIGS. 19 and 20 shows the differences in the bearing footprint 200 of a conventional in-line skate and the bearing footprint 210 of the off-line skate of this invention. These footprints 200 and 210 represent the area on the ground which effectively supports the weight of the skater. The conventional in-line skate has a substantially smaller bearing area than the off-line skate of this invention. The larger area bearing footprint 210 results from the unique, diagonal placement of the front and rear inboard and outboard wheels which, unlike in-line skates enables the off-line skate of this invention to stand upright, unsupported, without falling to either side. The footprint 210 is substantially wider than the footprint 200. Consequently, the off-line skate of this invention has greater stability and significantly increases the skater's capability to control and maneuver the skates. The unique diagonal placement of the front and rear inboard and outboard wheels coupled with the torsionally resistant support base or foot plate to which the wheels are mounted provides a stable platform from which the skater can easily leverage the skate into virtually any attitude or direction change instantly and with minimum effort. Thus, the skater may stand on, for example, the front inboard wheel 53 as depicted in FIG. 14, turn to the right as shown in FIG. 21, or turn to the left as shown in FIG. 22 by simply shifting his or her weight, leaning to front, right, or left, as the case may be.

Figure 12A:
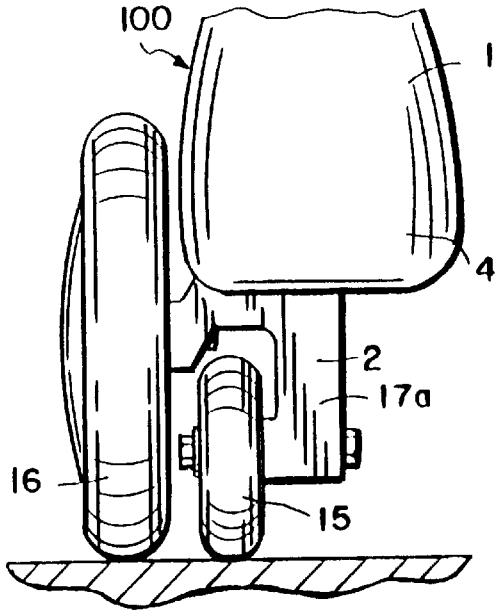
FIG. 12A is a view of the rear end of the left foot skate, looking forward at the heel of the skate, showing both back wheels on the ground when the skate is upright.
Figure 12B:
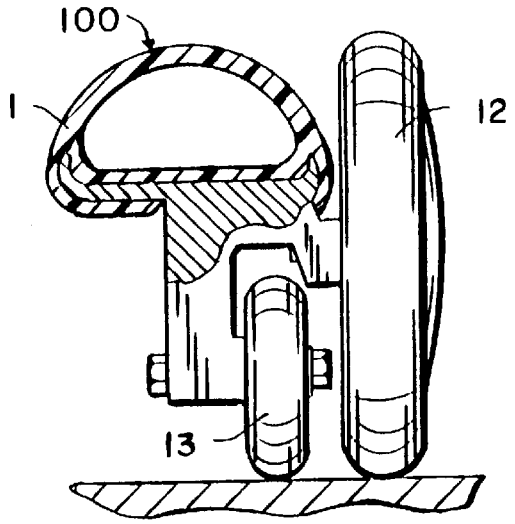
FIG. 12B is a cross-sectional view looking forward, showing both front wheels on the ground when the skate is upright.
Figure 13A:
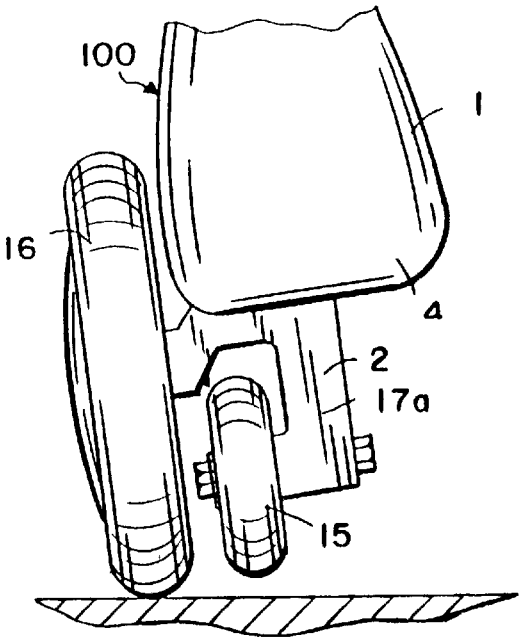
FIG. 13A is a view of the left foot skate, looking forward at the heel of the skate, showing the position of the rear wheels when the skater leans to the left.
Figure 13B:
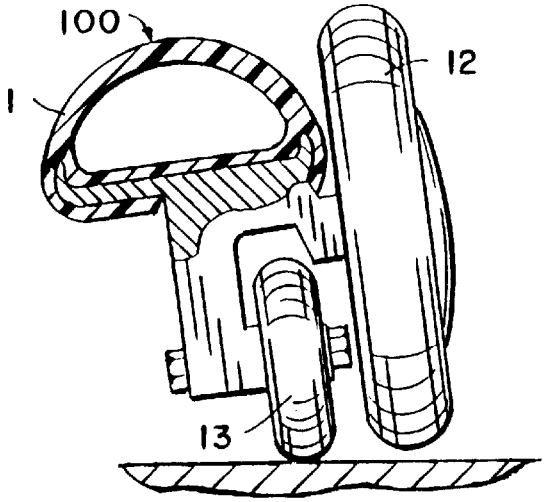
FIG. 13B is a a cross-sectional view looking forward, showing the position of the front wheels when the skater leans to the left.

With the unique wheel placement of this invention, improved leverage is provided and wheel shifting occurs as the skater leans to the right or left. The skater simply makes a slight shift in his or her weight to maneuver. FIGS. 12A and 12B and 13A and 13B and FIG. 15 illustrate the wheel shifting phenomenon provided by the unique wheel placement of this invention. As shown in FIGS. 12A and 12B, all the inboard and outboard wheels 12, 13, 15 and 16 sit flat on the ground when the skate 100 is erect. Wheel shifting occurs when the skater leans, or shifts his or her weight, to the right or the left. As illustrated in FIGS. 13A and 13B, when the skater leans to the left, the rear outboard wheel 16 and front inboard wheel 13 remain on the ground and the rear inboard wheel 15 and the front outboard wheel 12 lift off the ground. The reverse occurs when the skater leans to the right, with the rear outboard wheel 16 and front inboard wheel 13 lifting off the ground and the rear inboard wheel 15 and the front outboard wheel 12 remaining on the ground. The wheel shifting phenomenon is also shown in FIG. 15 where the skater leans to the right to lift the wheels 54 and 53 off the ground, with the wheels 55 and 52 remaining on the ground. Because of the unique lateral positioning of the wheels on the ground, when the skater leans or turns, the likelihood of the wheels skidding out and causing a fall is substantially reduced. Also when the skater does stunts or jumps and lands on the ground, the wider bearing footprint 210, in conjunction with the wheel shifting phenomenon, enhances the skater's ability to recover and not fall. Moreover, the diagonal wheel placement allows the skater to reverse directions and skate backwards easily. Thus, because of the diagonal wheel placement and the offset dual axle arrangement at the front and rear of the skate, there is greater stability and maneuverability of the skate, and the skater can more readily maintain balance or recover his or her balance.

The wheel shifting phenomenon occurs while skating during the pushing forward motion. For example, the diagonal positioning of the wheels 12, 13, 15 and 16 and the disparity in the wheel size, places more rearward thrust on the skate 100, creating a powerful forward motion. The larger wheels 12 and 16 have more momentum due to their size, creating an imbalance of force that provides greater forward thrust and sideways turning thrust. Thus the skater uses less effort to skate. Wheel shifting also allows more sideways thrust for turns. The use of proportionately larger diameter outboard wheels 12 and 16, with smaller sized inboard wheels 13 and 15, produces greater surface area contact with the road for greater leg driving acceleration force.

Figures 21, 22:
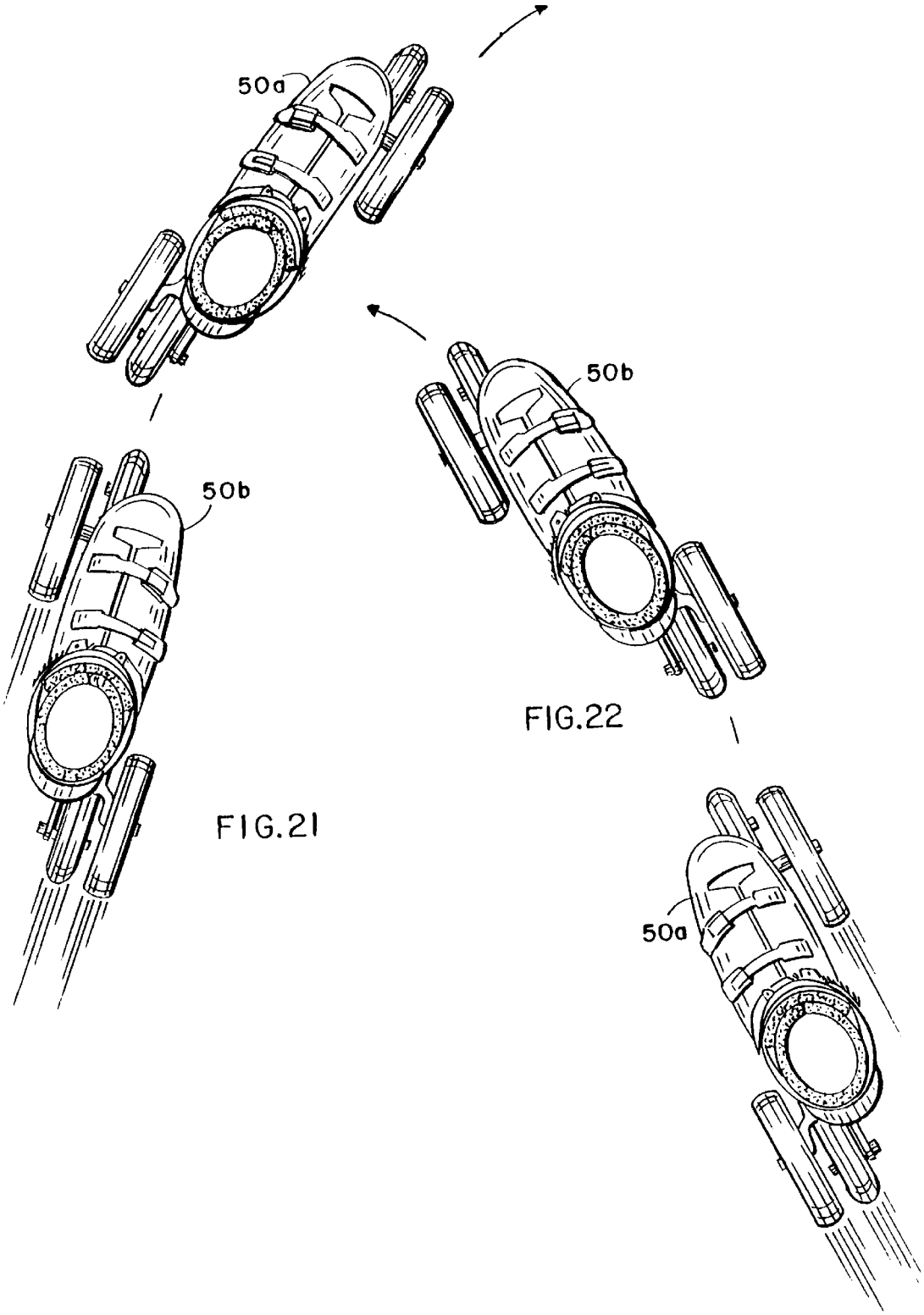
FIG. 21 is a plan showing the third embodiment skates turning to the right.
FIG. 22 is a plan showing the third embodiment skates turning to the left.

As best shown in FIGS. 21 and 22, in making a turn to the right, the left skate 50*a* is placed in front of the right skate 50*b* as the skater shifts his or her weight to the right, and in making a turn to the left the right skate 50*b* is placed in front of the left skate 50*a* as the skater shifts his or her weight to the right. When making the right turn, wheel shifting occurs in both skates. In the left foot skate 50*a*, the front outboard wheel and rear inboard wheel remain on the ground and the front inboard and rear outboard wheels lift off the ground. The opposite occurs with the right foot skate 50*a*. When making the left turn, wheel shifting also occurs in both skates. In the right foot skate 50*b*, the front outboard wheel and rear inboard wheel remain on the ground and the front inboard and rear outboard wheels lift off the ground. The opposite occurs with the left foot skate 50*a*.

The advantages of the off-line skate of this invention are manifold. The large diameter wheels provide a major reduction in the rate of cyclic fatigue. The spacing of the adjacent inboard and outboard wheels provide an effective broader thread for greater traction and safety. The large diameter wheels enable the skates to roll easily over rough terrain while significantly reducing the jarring effects experienced by conventional skates. The large diameter wheels store energy like a fly wheel to improve the coasting characteristics of the skate and provide greater safety at high speeds. Lower forces are needed to control the skates. The diagonal dual axle wheel arrangement of this skate coupled to a torsional resistant skate chassis (the base plate) with a conventional skate boot or ankle brace, eliminates torsional strain and provides upward support to the inside part of the ankle and foot. The result is a comfortable, relaxed environment for each foot. The interchangeabilty of wheels of different sizes offers broad performance diversification. The positioning of the outboard wheels to the sides of the skates enable a spring suspension to be incorporated into the skate allowing for off road skating. The inboard wheels improve stability, balance, especially for beginners, and provide a pivot point for jumps, tight turns, and spins for advanced skaters. The wheel configuration and positioning provides efficient energy utilization so that the skater uses the minimum energy to attain optimal stroke-to-glide ratio (the amount of force exerted per stroke/the glide distance achieved) for long distant skating.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A roller skate, including a support which is attached to a skater's foot, said support having a central longitudinal axis and a center line intersecting said longitudinal axis, first and second opposed sides, a forward end, and a rear end, a first pair of non-aligned axles attached to the forward end of the support and which extend sideways from the first side of the support, said forward end being forward of the center line, and a second pair of non-aligned axles attached to the rear end of the support and which extend sideways from the second side of the support, said rear end being rearward of the center line, a first pair of wheels mounted for rotation, one wheel of said first pair mounted to one of the axles of said first pair of axles and the other wheel of said first pair mounted to the other axle of said first pair of axles, a second pair of wheels mounted for rotation, one wheel of said second pair mounted to one of the axles of said second pair of axles and the other wheel of said second pair mounted to the other axle of said second pair of axles, said first pair of wheels positioned so that, upon attaching the support to the skater's foot with the longitudinal axis of the support aligned with the longitudinal axis of the skater's foot and said rear end near the heel of the skater's foot and said forward end near the toes of the skater's foot, one wheel of said first pair is to one side of the skater's foot and the other wheel of said first pair is below the skater's foot, with both said wheels of said first pair displaced from the longitudinal axis of the support towards the first side of the support, said second pair of wheels positioned so that, upon attaching the support to the skater's foot with the longitudinal axis of the support aligned with the longitudinal axis of the skater's foot and said rear end near the heel of the skater's foot and said forward end near the toes of the skater's foot, one wheel of said second pair is to the other side of the skater's foot and the other wheel of said second pair is below the skater's foot, with both said wheels of said second pair displaced from the longitudinal axis of the support towards the second side of the support.

2. The roller skate of claim 1 where the wheels mounted to the sides of the skater's foot have a larger diameter than the wheels mounted below the skater's foot.

3. The roller skate of claim 1 where the wheels mounted to the sides of the skater's foot have the same diameter as the wheels mounted below the skater's foot.

4. The roller skate of claim 2 where the larger diameter wheels are approximately twice the diameter of the wheels mounted below the skater's foot.

5. The roller skate of claim 1 where the axles carrying the wheels mounted to the sides of the skater's foot are positioned inward closer to the center of the skater's foot than the other axles.

6. The roller skate of claim 1 where the axle at the forward end of the support carrying the wheel mounted below the skater's foot is essentially under the big toe of the skater's foot.

7. The roller skate of claim 1 where the first pair of wheels are on the inside of the skater's foot and the second pair of wheels are on the outside of the skater's foot.

8. The roller skate of claim 1 where the wheel at the forward end of the support mounted below the skater's foot is adjustable to move to selected forward and rearward positions.

9. The roller skate of claim 1 where the wheel at the forward end of the support mounted below the skater's foot is adjustable to move to selected lateral positions.

10. The roller skate of claim 1 where, with respect to the first pair of axles, the axle carrying the wheel to one side of the skater's foot is positioned between the tip of the big toe and the ball of the skater's foot.

11. The roller skate of claim 1 where the diameters of the wheels are from 1 inch to 10 inches.

12. The roller skate of claim 1 where the diameters of the wheels mounted to the side of the skater's foot are from 2 inch to 10 inches.

13. The roller skate of claim 1 where the diameters of the wheels mounted to below the skater's foot are from 1 inch to 5 inches.

14. The roller skate of claim 1 where there is a brake member attached to the support.

15. A roller skate, including a support which is attached to a skater's foot, said support having a central longitudinal axis, opposed sides, and opposed ends which are rearward and forward of a center line intersecting the longitudinal axis, and a first, second, and third wheel mounted for rotation to the support, said first and second wheels being mounted on non-aligned, adjacent axles attached to one end of the support, said axles extending sideways from one side of the support, said first and second wheels being positioned so that, upon attaching the support to the skater's foot with the longitudinal axis of the support aligned with the longitudinal axis of the skater's foot and one end near the heel of the skater's foot and the other end near the toes of the skater's foot, the first wheel is to one side of the skater's foot and the second wheel is below the skater's foot, with both said first and second wheels displaced from the longitudinal axis of the support towards said one side of the support, said third wheel being mounted on another axle attached to the other end of the support and extending sideways from the other side of the support, said third wheel positioned on the other side of the skater's foot and displaced from the longitudinal axis of the support towards said other side of the support.

16. The roller skate of claim 15 where the wheels mounted to the sides of the skater's foot have a larger diameter than the wheel mounted below the skater's foot.

17. The roller skate of claim 16 where the larger diameter wheels are of the same diameter and approximately twice the diameter of the wheel mounted below the skater's foot.

18. The roller skate of claim 15 where the wheels mounted to the sides of the skater's foot have the same diameter as the wheels mounted below the skater's foot.

19. The roller skate of claim 15 where the wheels near the toes of the skater's foot is on the inside of the skater's foot.

20. A roller skate, including a support which is attached to a skater's foot, said support having a central longitudinal axis, an inside and an outside, a forward end, and a rear end, said forward and rear ends being respectively forward and rearward of a center line intersecting the longitudinal axis, first and second non-aligned axles attached to the forward end of the support and extending sideways from the inside of the support, with the first axle being closer to the forward end than the second axle, third and fourth non-aligned axles attached to the rear end of the support and extending sideways from the outside of the support, with the third axle being closer to the center of the skater's foot than the fourth axle, a pair of large wheels mounted for rotation having diameters approximately equal, one large wheel mounted to the second axle and the other large wheel mounted to the third axle, and a pair of small wheels mounted for rotation having approximately equal size diameters which are approximately half the diameter of the large wheels, one small wheel mounted to the first axle and the other small wheel mounted to the fourth axle, said large and small wheels positioned so that, when the support is attached to the skater's foot with the longitudinal axis of the support aligned with the longitudinal axis of the skater's foot and the rear end near the heel of the skater's foot and the forward end near the toes of the skater's foot, the large wheels are on opposite sides of the skater's foot and the small wheels are below the skater's foot on opposite sides of the longitudinal axis of the support.

21. The roller skate of claim 20 where the first axle is essentially under the big toe of the skater's foot.

22. The roller skate of claim 21 where the small wheel at the forward end of the support is adjustable to move to selected forward and rearward positions.

23. The roller skate of claim 20 where said small wheels are adjustable to move to selected lateral positions.

24. The roller skate of claim 20 where the second axle is positioned between the tip of the big toe and the ball of the skater's foot.

25. The roller skate of claim 20 where the third axle is positioned essentially below the heel of the skater's foot.

26. The roller skate of claim 20 where the fourth axle is positioned beyond the heel of the skater's foot.

27. The roller skate of claim 20 where the diameters of the wheels are from 1 inch to 10 inches.

28. The roller skate of claim 20 where the first and second axles are parallel to each other and are each at a right angle to said longitudinal axis and extend from the inside of the support, and the third and fourth axles are parallel to each other and are each at a right angle to said longitudinal axis and extend from the outside of the support.

29. A roller skate, including a support which is attached to a skater's foot, said support having a central longitudinal axis, an inside and an outside, a forward end, and a rear end, first and second non-aligned axles attached to the forward end of the support and extending sideways from the inside of the support, with the first axle being closer to the forward end than the second axle, said first axle being essentially under the big toe of the skater's foot, and said second axle being positioned between the tip of the big toe and the ball of the skater's foot, third and fourth non-aligned axles attached to the rear end of the support and extending sideways from the outside of the support, with the third axle being closer to the center of the skater's foot than the fourth axle and positioned essentially below the heel of the skater's foot and the fourth axle being positioned beyond the heel of the skater's foot, said first and second axles being parallel to each other with each at a right angle to said longitudinal axis, and the third and fourth axles being parallel to each other with each at a right angle to said longitudinal axis, a pair of large wheels mounted for rotation having diameters approximately equal, one large wheel mounted to the second axle and the other large wheel mounted to the third axle, and a pair of small wheels mounted for rotation having approximately equal size diameters smaller than the diameters of the large wheels, one small wheel mounted to the first axle and the other small wheel mounted to the fourth axle, said large and small wheels positioned so that, when the support is attached to the skater's foot with the longitudinal axis of the support aligned with the longitudinal axis of the skater's foot and the rear end near the heel of the skater's foot and the forward end near the toes of the skater's foot, the large wheels are on opposite sides of the skater's foot and the small wheels are below the skater's foot on opposite sides of the longitudinal axis of the support.

30. The roller skate of claim 29 where the small wheel at the forward end of the support is adjustable to move to selected forward and rearward positions, and both said small wheels are adjustable to move to selected lateral positions.

31. A roller skate, including a support which is attached to a skater's foot, said support having a central longitudinal axis, an inside and an outside, a forward end, and a rear end, first and second non-aligned axles attached to the forward end of the support and extending sideways from the inside of the support, with the first axle being closer to the forward end than the second axle, said first axle being essentially under the big toe of the skater's foot, and said second axle being positioned between the tip of the big toe and the ball of the skater's foot, third and fourth non-aligned axles attached to the rear end of the support and extending sideways from the outside of the support, with the third axle being closer to the center of the skater's foot than the fourth axle and positioned essentially below the heel of the skater's foot and the fourth axle being positioned beyond the heel of the skater's foot, said first and second axles being parallel to each other with each at a right angle to said longitudinal axis, and the third and fourth axles being parallel to each other with each at a right angle to said longitudinal axis, and a wheel mounted for rotation to each axle.

* * * * *